US006798128B2

(12) United States Patent
Roquais et al.

(10) Patent No.: US 6,798,128 B2
(45) Date of Patent: Sep. 28, 2004

(54) CATHODE-RAY TUBE CATHODE AND ALLOY THEREFOR

(75) Inventors: Jean-Michel Roquais, Dijon (FR); Fabian Poret, Dijon (FR); Régine Le Doze, Marsannay-la-Côte (FR); Marie Paul, Arc-sur-Tille (FR)

(73) Assignee: Thomson Licensing S.A., Bologne Cedex (FR)

( * ) Notice: Subject to any disclaimer, the term of this patent is extended or adjusted under 35 U.S.C. 154(b) by 272 days.

(21) Appl. No.: 09/841,954

(22) Filed: Apr. 25, 2001

(65) Prior Publication Data

US 2003/0164668 A1 Sep. 4, 2003

(30) Foreign Application Priority Data

Apr. 26, 2000 (FR) ..... 00 05306

(51) Int. Cl.[7] ..... H01J 1/14; H01J 19/06

(52) U.S. Cl. ..... 313/346 R; 313/337; 313/355; 313/270; 313/341; 216/41; 216/90; 216/100

(58) Field of Search ..... 313/346 R, 341, 313/270, 337; 216/90, 49

(56) References Cited

U.S. PATENT DOCUMENTS

| | | | | | |
|---|---|---|---|---|---|
| 4,184,100 | A | | 1/1980 | Takanashi et al. | 313/337 |
| 4,215,180 | A | * | 7/1980 | Misumi et al. | 313/341 |
| 4,376,009 | A | * | 3/1983 | Kunz | 216/90 |
| 4,382,206 | A | * | 5/1983 | Kumada et al. | 313/346 R |
| 4,441,957 | A | * | 4/1984 | Poff et al. | 216/49 |
| 4,536,259 | A | * | 8/1985 | Oda et al. | 205/238 |
| 4,636,681 | A | * | 1/1987 | Misumi | 313/346 R |
| 4,820,954 | A | | 4/1989 | Kimura et al. | 313/270 |
| 4,849,066 | A | * | 7/1989 | Deal et al. | 216/90 |
| 4,904,896 | A | * | 2/1990 | Chiang | 313/337 |
| 4,924,137 | A | * | 5/1990 | Watanabe et al. | 313/346 R |
| 5,220,238 | A | | 6/1993 | Lee | 313/270 |
| 5,900,692 | A | | 5/1999 | Jung et al. | 313/417 |
| 6,124,666 | A | * | 9/2000 | Saito et al. | 313/346 R |

* cited by examiner

*Primary Examiner*—Nimeshkumar D. Patel
*Assistant Examiner*—Sikha Roy
(74) *Attorney, Agent, or Firm*—Joseph S. Tripoli; Joseph J. Laks; Carlos M. Herrera

(57) ABSTRACT

A nickel alloy for the manufacture of cathodes for cathode-ray tubes, comprises magnesium and aluminium in proportions chosen so as to allow good adhesion of an emissive oxide layer to the basis metal cap consisting of the alloy.

4 Claims, 2 Drawing Sheets

CATHODE-RAY TUBE CATHODE AND ALLOY THEREFOR

The invention relates to cathode-ray tube oxide cathodes, used as sources of electrons emitted by the thermionic effect, and more particularly to the composition of the metal forming the basis of the cathode.

BACKGROUND OF THE INVENTION

A conventional oxide cathode consists of a layer of alkaline-earth oxides, such as a mixture of barium oxide (BaO), strontium oxide (SrO) and calcium oxide (CaO) or a mixture of BaO and SrO, which is deposited on a basis metal made of nickel or a nickel alloy and comprising one or more reducing elements, such as magnesium (Mg), aluminium (Al), silicon (Si), chromium (Cr), zirconium (Zr) or any other element capable of reducing oxides. The alkaline-earth oxide mixture may itself be doped with other oxides, such as, for example, $Sc_2O_3$ and $Y_2O_3$.

A conventional oxide cathode is constructed of a tube made of a Ni alloy (generally Ni—Cr) to which a cap made in the basis metal is welded. Deposited on the basis metal is a layer made of a mixture of Ba and Sr carbonates or a mixture of Ba, Sr and Ca carbonates. These carbonates, which are stable in air, are subsequently converted to oxides in the vacuum inside the cathode-ray tube. This oxide layer, heated to a cathode working temperature of approximately 800° C., becomes the electron-emitting layer when some of the BaO is converted to barium metal.

The formation of barium metal is maintained by the following mechanisms; the cathode, during operation, is heated to a temperature of approximately 800° C., causing the reducing elements to diffuse towards the interface between the nickel and the alkaline-earth oxides. These reducing elements, for example, Mg, Al and Si, constantly react with the barium oxide and reduce it, in order to form barium metal according to the reactions:

$$Mg + BaO \longrightarrow MgO + Ba$$

$$2Al + 4\ BaO \longrightarrow BaAl_2O_4 + 3\ Ba$$

$$Si + 4\ BaO \longrightarrow Ba_2SiO_4 + 2\ Ba.$$

The reducing elements added to the nickel are therefore consumed by the chemical oxidation-reduction reactions with BaO. The lifetime of the cathode is directly connected with the consumption of these elements so that, for each of the addition reducing elements chosen, a minimum content is desirable in order to guarantee a minimum lifetime. Furthermore, it is known that some of the compounds resulting from the Ba reduction reactions described above, such as $Ba_2SiO_4$ or $BaAl_2O_4$, are so highly stable that they can accumulate at the interface [A. Eisenstein, H. John et al., J. Appl. Phys., T.24, No. 5, p. 631, 1953] between the nickel and the alkaline-earth oxides. These compounds, because of their high resistivity, increase the impedance of the interface, thereby reducing the current density of the cathode. In addition, they degrade the lifetime of the cathode because they permanently accumulate at the interface during operation of the cathode. By accumulating, they limit the diffusion of the reducing elements and thus decrease the reactions between the latter and BaO, which in turn reduces the amount of Ba metal formed, which is necessary for emission [E. S. Rittner, Philips Res. Rep., T.8, p.184, 1953]. Another major drawback is that an excessively high accumulation of these compounds may degrade the adhesion of the alkaline-earth oxides to the nickel.

The invention aims to avoid these drawbacks by properly choosing a composition of the material forming the basis of the cathode, which material consists of a nickel alloy for which the content of reducing elements must be chosen within a defined weight concentration range according to the elements in question. Each reducing element is added to the nickel in a concentration range defined by a lower limit and an upper limit, which range guarantees a long lifetime as well as optimum emission performance and reliability. To achieve this result, the metal alloy according to the invention, intended for the manufacture of cathodes for cathode-ray tubes, mainly comprises nickel, together with magnesium (Mg), the weight concentration $C_{Mg}$ of which is between 0.01% and 0.1%. Advantageously, it also includes aluminium, the weight concentration $C_{Al}$ of which satisfies the relationship:

$$C_{Al} \leqq 0.14 \times (0.1 - C_{Mg}),$$

where:

$C_{mg}$ is the Mg concentration in the nickel expressed as a percentage by weight;

$C_{Al}$ is the Al concentration in the nickel expressed as a percentage by weight.

BRIEF DESCRIPTION OF THE DRAWINGS

The invention and its various advantages will be more clearly understood with the help of the, description below and of the drawings in which.

DETAILED DESCRIPTION OF THE PREFERRED EMBODIMENTS

A cathode-ray tube comprises at least one source for creating an electron beam intended to scan the tube's screen in order to excite phosphors thereon, these being intended to create a visible image.

Figure 1:
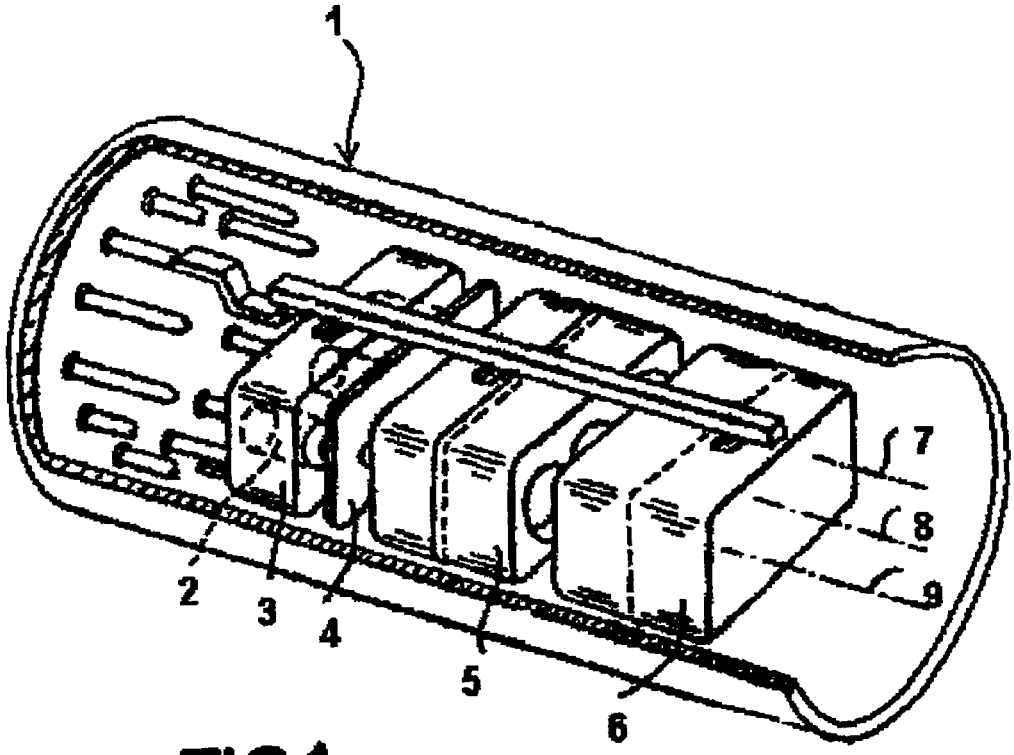
FIG. 1 illustrates an electron gun for a cathode-ray tube.

As shown in FIG. 1, the tube's gun 1 therefore comprises at least one cathode 2 and a succession of electrodes (3, 4, 5, 6, etc.) which are intended to form the electron beam or beams 7, 8, 9 and to focus it or them onto the screen of the tube.

Figure 2:
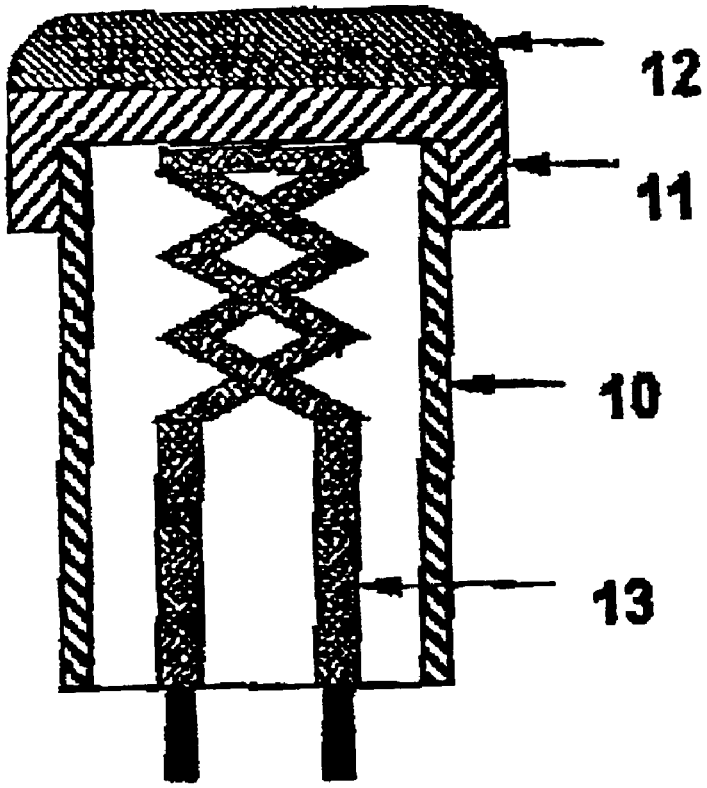
FIG. 2 is a longitudinal section through an oxide cathode according to the invention.

As shown in FIG. 2, the cathode 2 is generally in the form of an approximately cylindrical hollow tube 10, made of nickel or nickel alloy, for example nickel-chromium. The tube 10 is closed at one of its ends by a cap 11 which may be either an attached metal piece or an integral part of the tube, obtained by drawing. The cap is made of a nickel alloy and serves as a support for the emissive layer 12 of alkaline-earth oxides. This layer 12, heated to high temperature by the filament 13, becomes the source of the electron beam intended to scan the surface of the tube's screen.

When the nickel of conventional oxide cathodes is heated, compounds may form, not only as a result of the reduction of the barium oxide BaO by reducing elements, but also by direct reaction of the reducing elements, with the residual oxygen present in the nickel or with the oxygen present in the atmospheres to which the nickel is exposed during the various steps in the production of the cathodes. For example, the production of cathodes usually includes a step of annealing the basis metal in hydrogen at a temperature close to 1000° C. The water ($H_2O$) content of the hydrogen is generally very low, so that the atmosphere is reducing for nickel at the annealing temperature. On the other hand, the $H_2O$ content, even if it is reducing for nickel, may be sufficient to oxidize the reducing elements present in the nickel, such as Mg and Al. Magnesia (MgO) and alumina ($Al_2O_3$) thus form on the surface of the nickel during annealing. More complex compounds resulting from the reaction of two reducing elements with oxygen are also observed, for example, $MgAl_2O_4$ or $BaAl_2O_4$, the latter being observed as a result of the chemical reaction of the reducing elements with the alkaline-earth oxides. The formation of these compounds was studied together with their persistence during the step of activating the cathode in the cathode-ray tube. During this activation step, the cathode is heated in the vacuum of the cathode-ray tube (typically, $p<10^{-6}$ torr) at a maximum temperature of between 900° C. and 1100° C. The purpose of this operation is, on the one hand, to convert the carbonates to oxides and, on the other hand, to optimize the electron emission of the cathode. For nickels of various Mg and Al compositions, the compound $MgAl_2O_4$ is formed during the hydrogen annealing step at the interface between the basis metal of the cap 11 and the coating of emissive oxides. This compound is a stable compound and is in the form of small crystallites partially covering the nickel surface and having a tendency to accumulate at the interface during the life of the cathode.

Since this type of stable compound is deleterious, its presence at the interface must be limited as far as possible so as to maintain good adhesion of the oxide layer to the basis metal.

The amount of crystallites was determined by image analysis on images of nickel surfaces taken in a scanning electron microscope (SEM). The percentage of surface covered by the crystallites could be measured by image analysis since these crystallites appear white against a black nickel background. This percentage was measured after the activation step in the cathode-ray tube; that is to say, it represents the crystallites which persist after activation and are present at the start of the cathode's life.

$C_{Mg}$ is the Mg concentration in the nickel expressed as a percentage by weight;

$C_{Al}$ is the Al concentration in the nickel expressed as a percentage by weight.

It is common practice to have a minimum magnesium content in the nickel since magnesium is highly reducing and diffuses very rapidly. Consequently, magnesium ensures that the cathode is activated quickly during the activation process described above and ensures proper electron emission during the first few hundred or so hours of the cathode's life. Since magnesium has this favorable behavior, it is preferable, in order to limit the amount of $MgAl_2O_4$ crystallites, to optimize the Al content rather than limit the magnesium content.

The magnesium content may advantageously be set to a value of between 0.01% and 0.1%. Knowing, from experience, that the maximum percentage of stable crystallites considered as acceptable, that is to say, giving good adhesion of the oxide layer to the basis metal, is 3%, the maximum Al content of the nickel alloy according to the invention is calculated from the magnesium content, using the following equation derived from equation (1):

$$C_{Al} \leqq 0.14 \times (06.1 - C_{mg}) \quad (2)$$

The following table shows the variations in the adhesion of the oxide layer according to the various magnesium and aluminium contents in the basis metal. Good adhesion is therefore well guaranteed when the inequality (2) is satisfied.

| Mg (wt %) | Al (wt %) | 0.14 [0.1-$C_{Mg}$] (wt %) | Measured crystallites (% of surface) | Calculated crystallites (% of surface) | Oxide layer/ basis metal adhesion |
|---|---|---|---|---|---|
| 0.0085 | 0.006 | 0.01281 | 0.05 | 0.525 | Good |
| 0.014 | 0.003 | 0.01204 | 0.025 | −0.25 | Good |
| 0.02 | 0.006 | 0.0112 | 0.5 | 1.1 | Good |
| 0.025 | 0.003 | 0.0105 | 0.35 | 0.3 | Good |
| 0.028 | 0.006 | 0.01008 | 0.45 | 1.5 | Good |
| 0.03 | 0.013 | 0.0098 | 4.9 | 4.05 | Occasional faults |
| 0.031 | 0.004 | 0.00966 | 1.3 | 0.95 | Good |
| 0.032 | 0.008 | 0.00952 | 3.2 | 2.4 | Good |
| 0.032 | 0.011 | 0.00952 | 5.5 | 3.45 | Occasional faults |
| 0.04 | 0.02 | 0.0084 | 6 | 7 | Occasional faults |
| 0.056 | 0.003 | 0.00616 | 1.4 | 1.85 | Good |

Table: percentage of nickel surface covered by crystallites for various magnesium and aluminium contents in the nickel (measured values and values calculated from equation(1)).

Statistical analysis of the experimental measurements of the amount of coverage by the crystallites present on the surface of the basis metal after the activation carried out on several nickel castings has shown that it is relevant to link the amount of coverage by stable crystallites to the magnesium and aluminium concentrations of the basis metal.

Results from this analysis have led to the equation which represents this percentage of surface coverage, and therefore the amount of surface crystallites, as a function of the aluminium content and the magnesium content in the alloy forming the basis metal:

$$C_s = [-2 + (50 \times C_{mg}) + (350 \times C_{al})]\% \quad (1)$$

where:

$C_s$ is the percentage of nickel surface covered by crystallites;

What is claimed is:

1. A cathode ray tube having a cathode for emitting electrons that form an electron beam therein, said cathode comprising:

a basis metal formed of a metal alloy, said alloy including mainly nickel and a weight concentration $C_{mg}$ of magnesium (Mg) which is between 0.01% and 0.1%, said alloy also includes aluminum, the weight concentration $C_{Al}$ of which satisfies the relationship:

$$C_{Al} \leqq 0.14 \times (0.1 \times C_{Mg}).$$

2. A cathode ray tube having a cathode for emitting electrons that form an electron beam therein, said cathode comprising:

a basis metal formed of a metal alloy, said alloy including mainly nickel and a weight concentration $C_{Mg}$ of magnesium (Mg) which is between 0.01% and 0.1%, said alloy also contains a weight concentration $C_{Al}$ of aluminum such that, after the cathode has been activated, the percentage of the surface of the alloy below an emissive layer of the cathode covered by stable crystallites is less than or equal to 3%.

3. The cathode ray tube according to claim 1, wherein said basis metal includes an emissive part consisting of a layer of alkaline-earth oxides.

4. The cathode ray tube according to claim 2, wherein said basis metal includes an emissive part consisting of a layer of alkaline-earth oxides.

* * * * *

UNITED STATES PATENT AND TRADEMARK OFFICE

CERTIFICATE OF CORRECTION

PATENT NO. : 6,798,128 B2
DATED : September 28, 2004
INVENTOR(S) : Le Doze Regine et al.

It is certified that error appears in the above-identified patent and that said Letters Patent is hereby corrected as shown below:

Column 4,
Line 53, should read:
-- A cathode ray tube having a cathode for emitting electrons that form an electron beam therein, said cathode comprising:
a basis metal formed of a metal alloy, said alloy including mainly nickel and a weight concentration $C_{mg}$
of magnesium (Mg) which is between 0.01% and 0.1%, said alloy also includes aluminum, the weight concentration $C_{Al}$ of which satisfies the relationship:

$$C_{A1} \leq 0.14x(0.1-C_{Mg}).$$ --.

Column 6,
Line 4, should read:
-- The cathode ray tube according to Claim 3, wherein said basis metal includes an emissive part consisting of a layer of alkaline-earth oxides. --.

Signed and Sealed this

Thirty-first Day of January, 2006

JON W. DUDAS
*Director of the United States Patent and Trademark Office*